United States Patent [19]

Büchler-Dopheide

[11] Patent Number: 4,744,509

[45] Date of Patent: May 17, 1988

[54] FOLDABLE LETTER THAT CAN BE MAILED

[76] Inventor: Ingrid Büchler
Waldstrasse 86, D-6640 Merzig, Fed. Rep. of Germany

[21] Appl. No.: 852,448

[22] PCT Filed: Jun. 20, 1985

[86] PCT No.: PCT/DE85/00209

§ 371 Date: Feb. 19, 1986

§ 102(e) Date: Feb. 19, 1986

[87] PCT Pub. No.: WO86/00276

PCT Pub. Date: Jan. 16, 1986

[30] Foreign Application Priority Data

Jun. 20, 1984 [DE] Fed. Rep. of Germany ..... 3422771
Mar. 7, 1985 [DE] Fed. Rep. of Germany ..... 3508116

[51] Int. Cl.[4] ..... B65D 27/00

[52] U.S. Cl. ..... 229/92.1; 229/92; 229/75; 229/68 R

[58] Field of Search ..... 229/92.1, 92.7, 92, 229/75, 68 R, 41 B, 40, 69

[56] References Cited

U.S. PATENT DOCUMENTS

| | | | |
|---|---|---|---|
| 284,297 | 9/1883 | Hartwell | 229/92.1 |
| 923,111 | 5/1909 | Boberg | 229/84 |
| 1219635 | 3/1917 | French | 229/82 |
| 1,760,106 | 5/1930 | Beach | 206/46 |
| 1,850,883 | 3/1932 | Kehl | 229/92.1 |
| 3,458,112 | 7/1969 | Nelson | 229/87 R |
| 3,635,392 | 1/1972 | Burgher | 229/8 X |
| 3,708,107 | 1/1973 | Williams | 229/69 |

FOREIGN PATENT DOCUMENTS

| | | | |
|---|---|---|---|
| 474636 | 3/1915 | France . | |
| 1157234 | 5/1958 | France . | |
| 1238882 | 7/1960 | France . | |
| 2156418 | 10/1971 | France . | |
| 331032 | 6/1930 | United Kingdom | 229/75 |
| 0553816 | 6/1943 | United Kingdom . | |

*Primary Examiner*—Willis Little
*Attorney, Agent, or Firm*—Becker & Becker, Inc.

[57] ABSTRACT

A foldable letter that can be mailed. The latter encompasses a cut-out paper sheet, one surface of which is intended to receive communications or messages, and the other side of which is intended to receive postal indications, i.e., an address. This letter solves the double problem of finding a form that encourages the writing of letters in the face of the progression of electronic communication equipment and, on the other hand, of enabling easy opening of a folded and sealed letter without tearing it. The proposed solution relates to an appropriate carrier for handwritten communications, and a closure technique offering to the receiver an acceptable letter in its original size. The letter has a square basic shape and includes a rectangular field, the long sides of which are parallel, but not symmetrical, to one of the diagonals of the square. The four triangular closure flaps of the sheet are folded back to one face or side of the letter, and the edges of the flaps completely overlap and stick to one another. The side of the sheet that receives the communication is preferably lined on its entire surface, and parallel to two of the edges. Furthermore, the edges provided for the closure are provided on one side with detachable strips which, after the letter is opened, remain fixed to the nonwritten side. For this purpose, these strips are provided with a perforation.

24 Claims, 8 Drawing Sheets

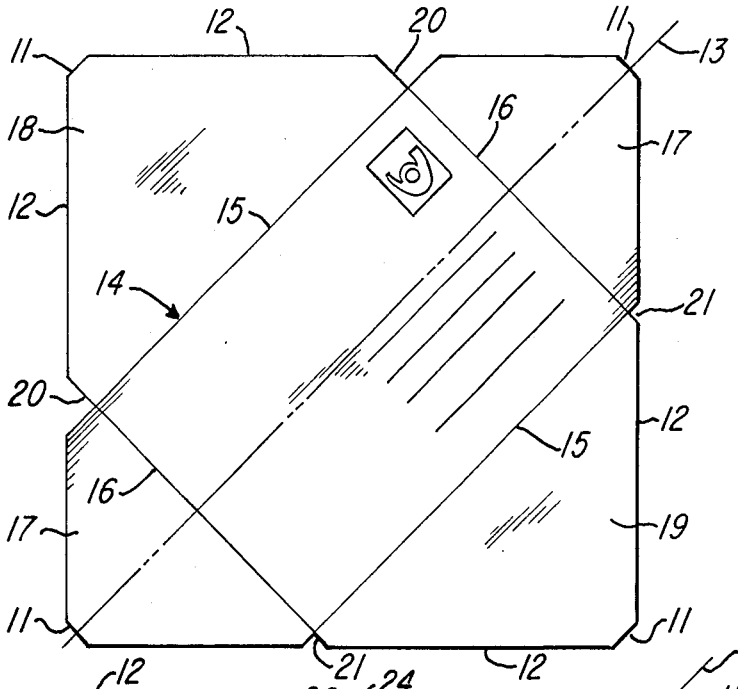
FIG-2
FIG-4
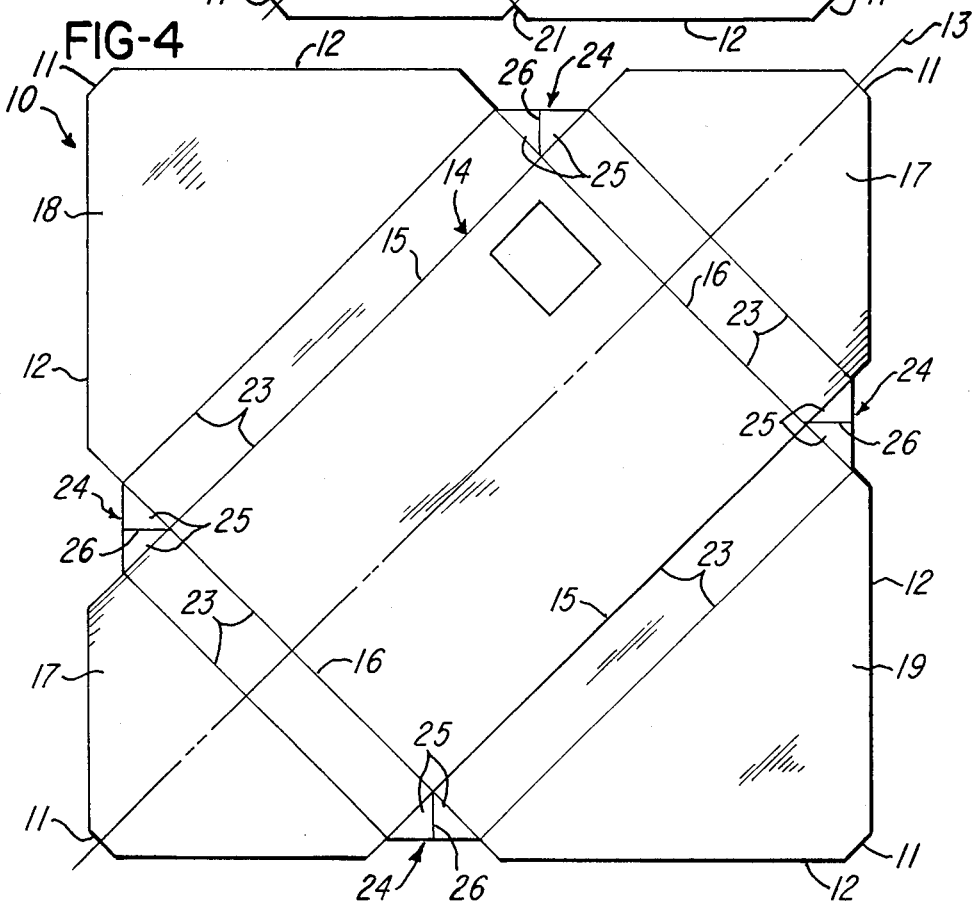

FOLDABLE LETTER THAT CAN BE MAILED

BACKGROUND OF THE INVENTION

1. Field of the Invention

The present invention relates to a foldable letter that can be mailed, and includes a sheet of paper having an essentially square basic shape within which, on both sides, appears a rectangular field that is of such a size, and that is disposed non-symmetrically and at an angle relative to the square in such a way, that the corners of the rectangle inscribed in the square are spaced from the edges or sides of the square; at those locations where the corners of the rectangle are near the sides of the square, triangular notches are provided, with the most indented point of each notch coinciding with a corner of the rectangle; the four sides of the rectangle each form both a folding line and a base of a triangular closure flap; after the closure flaps have been folded over to one side, the foldable letter can be sealed as a rectangular letter, with strips having an adhesive, such as glue, being provided on one side to secure the closure flaps.

2. Description of the Prior Art

French Patent No. 12 38 882 discloses a packaging sheet in the form of an envelope for particularly valuable journals. This packaging sheet has the features previously described but is not a letter in the normal sense of this word. Thus, this packaging sheet does not involve a sheet that can carry a message, but rather involves wrapping paper for the journal, and is thrown away after the journal is unwrapped. Securing of the closure flaps, and hence sealing of the wrapping, is effected by a separate adhesive strip. As a result, this packaging sheet, even if it were to involve an envelope, would not be suitable for ensuring secrecy of the mail.

A similar-type foldable letter is disclosed in British Patent No. 553 816. This letter starts with a rectangular basic shape in which is also non-symmetrically disposed a rectangular field which results by folding-over external surface parts of the basic shape in a very specific sequence, and which determines the later shape of the sealed letter. However, in contrast to a conventional envelope, this folding-over does not involve independent triangular portions. Rather, the folding of the surface parts in each case also includes regions of the adjacent surface parts, so that the surface parts are of double thickness in certain regions. The gluing does not involve strips located near the edges; rather, a central closure is utilized that cannot assure the secrecy of the mail.

A similar situation is involved with the subject matter of published French application No. 22 89 404, although here, too, a square basic shape having a symmetrically inscribed square for the message can be provided. Sealing of this foldable letter is effected with a plurality of separate strips.

U.S. Pat. No. 960,384 Norman dated Jun. 7, 1910 discloses an envelope having triple, parallel folding lines that extend all the way around; integrally formed-on folding parts are provided at the corners. Due to the presence of triple folding lines, there results a variable packaging thickness of the envelope. However, this brings about a complicated folding process that must be carried out very carefully if a clean exterior appearance of the letter is to be achieved.

Finally, also known are variously reinforced envelopes, and envelopes having carbon paper glued to the inside (German Gebrauchsmusters Nos. 17 37 655 and 82 23 478). For the sake of completeness, though not in any detail, reference is also made to the well-known, so-called air letters (light weight air mail letters) and the customary two-part letters that comprise a sheet of writing paper and an envelope.

The present invention is concerned with the problem of transmitting communications between people. This includes communication via other than the spoken word, especially the written word, but also, for example, a combination of written and pictorial combination. The requirement for communication basically includes all so-called interaction areas, in other words, not just private communications, but also all other communications, including business communications. Even today, the personal writing style of a person can have an important effect; with regard to personal letters, this is even more true when using one's own handwriting. Confronting such personal communication is the increasing use of such communication means where, for reasons of economy, such individual communications are completely, or at least to a large extent, dispensed with. Examples include electronic communication transmitting devices that demand abbreviated language, or even produce an artificial language which is then uniform for all users. It is a concern of the present invention to take steps against this development, which has negative effects on any kind of individuality; one contribution to this cause can be the promotion of the writing and transmitting of letters.

DISCLOSURE OF THE INVENTION

An object of the present invention therefore is to provide a means that can be mailed and that is especially intended for written messages, but if necessary can also be used for objects. On a broad base, such a means offers the incentive to more often use this form of communication. The present invention proceeds from a foldable letter having the aforementioned general type of features. Beyond the ability to be mailed, however, the foldable letter should primarily be practical, i.e. should offer a large writing field for the messages, and should have a closure that is fully satisfactory for mailing. Moreover, the closure technique should be suitable for a wide range of weights of paper without having to fear that the letter might rip when it is opened. The foldable letter, when it is opened by the receiver, should again offer the original shape of a sheet of paper.

The foldable letter of the present invention is characterized primarily in that the long sides of the rectangular field are parallel to an imaginery corner-to-corner diagonal of the square, but are disposed non-symmetrically relative to this diagonal in such a way that the four triangular closure flaps, after having been folded over to one and the same side, completely seal the foldable letter via overlapping ones of their edge portions, which are to be glued, whereby near these edge portions of some of the closure flaps, and on one side of the latter, strip-like sections are provided that have said adhesive provided thereon.

It should be noted that the corners of a square can be broken off, for example they can be chamfered or rounded off.

It is also possible to partially or entirely reinforce the sheet of paper, for example with a laminated-on fabric layer, or with a plastic or aluminum foil that is placed thereon.

The present invention has the advantage that all those who wish to communicate, either personally, or in business, and possibly even officially, have available a message carrier that can be handled as simply as a postcard, but avoids the drawback of the lack of secrecy of the latter, and above all offers a lot more writing space. The inventive foldable letter can also be provided with messages where its surface forms a closure component, with the sum of these surface parts leading to approximately a doubling of the surface area of the letter in its ready-to-mail state. The receiver of the mailed letter, while being spared a separate envelope, receives a letter sheet of relatively large size and pleasing format which is not disfigured by the necessary sealing and reopening.

Brief Description of the Drawings

Illustrated in the drawings are specific embodiments of the present invention that will be described subsequently. Shown are:

FIG. 2 the foldable letter of FIG. 1 viewed from the side on which the address is to appear, FIG. 3 the foldable letter of FIGS. 1 and 2 in the sealed (folded) state, FIG. 4 a foldable box-letter, in an unfolded state, FIG. 5 a schematic illustration of a foldable box-letter having a flower holder, FIG. 6 a nonfolded foldable letter viewed from the message side, FIG. 7 the foldable letter of FIG. 6 in the sealed (folded) state, and indicating means for opening the letter, FIG. 8 the foldable letter of FIG. 7 after the first opening step, FIG. 9 the foldable letter of FIG. 8 after the second opening step, FIG. 10 the entire opened or unfolded foldable letter viewed from that side on which the address appears.

EMBODIMENTS OF THE INVENTION

Figure 1:
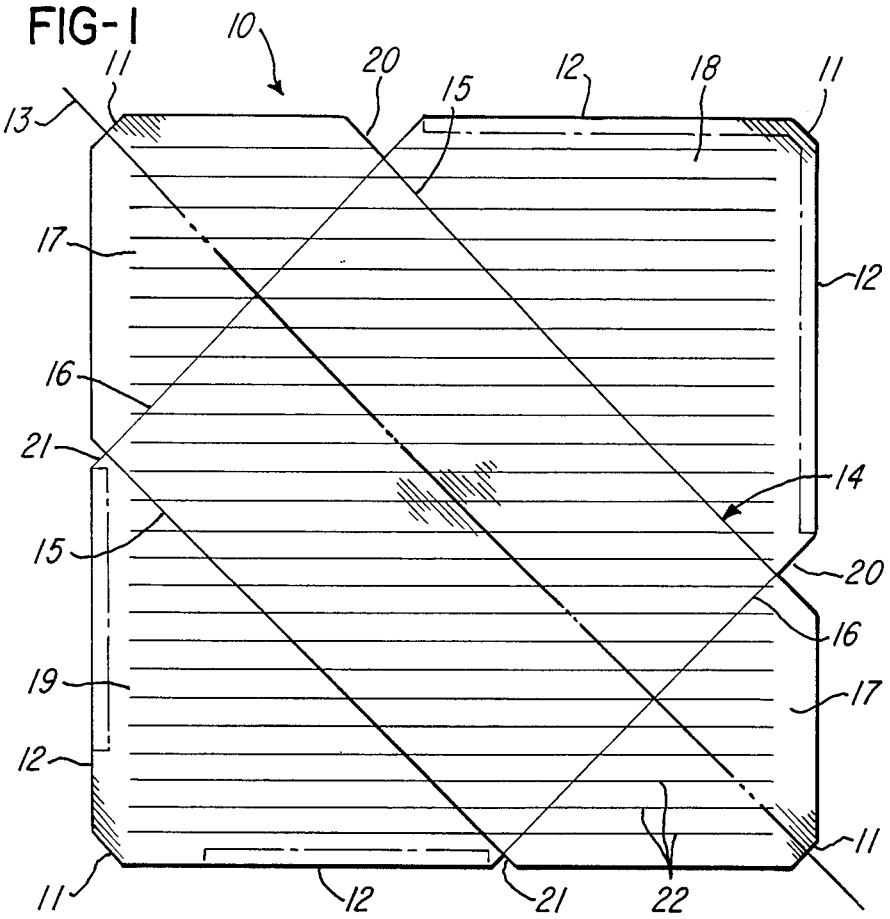
FIG. 1 a nonfolded or flat foldable letter viewed from the message side.
Figure 3:
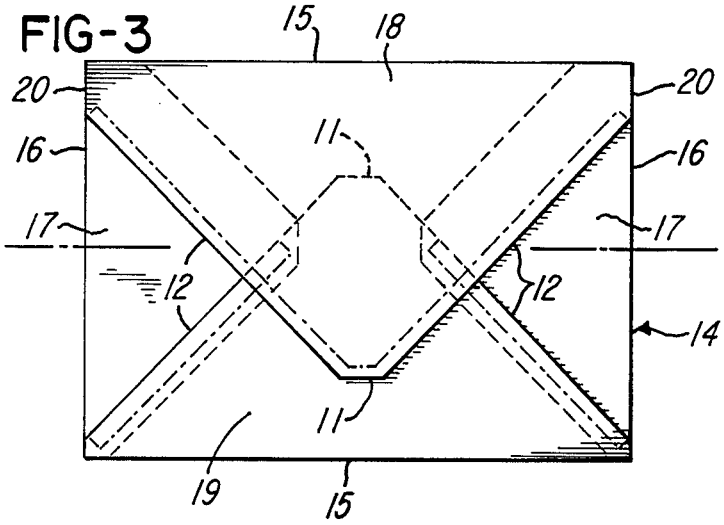

As shown in FIGS. 1, 2, 6 and 10, the foldable letter comprises a generally square sheet 10 of stationery, mainly of a relatively thick quality. The four corners 11 of the square are cut off short. The square also has four edges or sides 12, and a corner-to-corner diagonal 13 that is illustrated only for the purpose of the specification. The square sheet 10 has an overall dimension of 210 by 210 mm, so that this sheet can be placed in organizers and files that are provided for the paper size DIN A4.

A rectangular field 14 is arranged in the square sheet 10 in such a way that the long sides 15 of the rectangular field extend parallel to the diagonal 13, while the short sides 16 of the rectangular field are divided by the diagonal 13, although not into two equal parts. Rather, the diagonal 13 extends nonsymmetrically through the rectangular field 14, dividing each short side 16 into a shorter and a longer section. In the illustrated embodiment, the overall dimensions of the rectangular field 14 are 114 by 162 mm, in other words, size DIN C6. The diagonal 13 divides the short sides 16 of the rectangular field 14, which is inscribed in the square sheet 10, into respective sections of 60 and 54 mm length. Since the four sides 15, 16 of the rectangle 14 form the folding lines and at the same time the respective bases of respective triangular closure flaps, the latter are not completely symmetrical relative to the rectangule 14, but rather are offset relative to one another, so that when the foldable letter is folded and closed, these flaps expediently overlap one another while forming appropriately wide strips.

As shown in FIGS. 1–3 and 6, the triangular closure flaps 17 on the short sides 16 of the rectangle 14 are the same size, whereas the closure flaps on the long sides 15 are different sizes; in particular, the closure flap 18 is larger than the closure flap 19. Since the corners of the rectangle 14, which is inscribed in the square of the sheet 10, do not contact the sides 12 of the square, but rather are spaced from these sides 12, there result at the pertaining four locations triangular notches 20, 21 which, in pairs, are of different sizes. In particular, the notches 20 in the vicinity of the larger closure flap 18 are larger and deeper. In this way, in the closed state of the foldable letter, there results an improved starting point for a suitable device for unfolding or opening the letter (see FIG. 3).

From the drawings, it can furthermore be clearly seen that the rectangle 14 appears on both sides of the square 10. In particular, on the message side shown in FIG. 1, the rectangle 14 is formed practically only by the fold lines along the long sides 15 and the short sides 16. In contrast, on the side for the postal indications or address, as shown in FIG. 2, and which later becomes the main side of the letter when it is ready for mailing, the rectangle is formed for receiving the address of the receiver, and can be provided with imprinted stamps, and possibly with an indication of the mailer of the letter and/or of the purpose and also the content of the letter, for example, POST-OFFICE LETTER - GREETINGS. Similarly, a return address can be provided either within the rectangle 14, or on the large closure flap 18. In order to utilize the full area of the sheet, the message side is printed with lines 22 as an aid in writing. These lines extend parallel to two of the edges of the square, in other words, do not extend parallel to the edges of the rectangle 14. However, other arrangements are also possible; for example pictorial illustrations could also be provided within the rectangle 14, with these pictures then being surrounded by writing areas for messages.

In the foldable letter illustrated in FIG. 4, double, parallel folding lines 23 are provided that surround the rectangle 14, so that when the sheet is appropriately folded, a flat board results that forms an appropriate box, as a result of which the foldable letter is made suitable for sending goods as a small package. Provided on the corners of the board or box are paper joints or hinges 24 in the form of intermediate folding parts that are integrated in the sheet 10, and are each comprised of two small triangles 25, the common central line 26 of which forms a joint or hinge axis that pivots inwardly when the sheet is folded and the box is formed. With the easy assistance of the hand, the hinge 24 can be placed against one of the two adjacent sidewalls of the box, so that no space is lost within the latter. At the same time, the interior of the box is tightly closed, and can only be made accessible from the corners by exerting great force.

Figure 5:
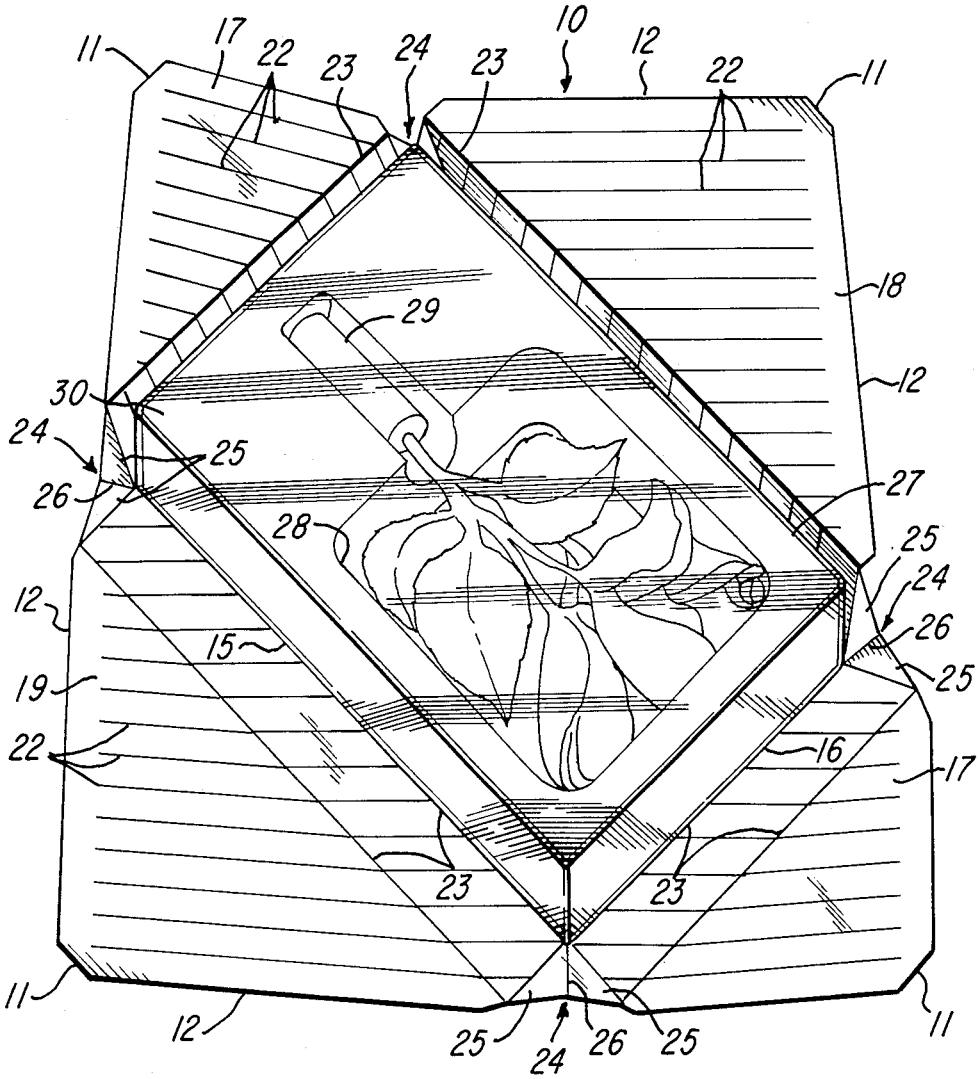

So that the box folded from the sheet of paper 10 has a minimum stability of shape and resistance to rough handling during transit, it is possible, as shown in FIG. 5, to fill the box with a receptacle that essentially fits exactly into the box and which is then surrounded on all sides by the sheet of paper. As shown in FIG. 5, the receptacle comprises a light plastic having a central cutout 28 of such a shape that a single flower, along with its leaves and stem cut to length, can be placed in the cutout. A small plastic container 29 that can be sealed, and that contains a liquid nutrient such as water, can be placed in that area of the cutout 28 provided for the stem. Such plastic containers are common in the flower industry. The block 27 and its contents are covered from the outside so that the contents are visible. This can be done, for example, by placing the block in a clear box or slide that is open at both ends, or, as shown in FIG. 5, by covering the block with a clear box cover 30 that is open at the bottom and that has a thickness that takes into account the dimensions of the block 27, so that the interior formed by the sheet 10 for the box is completely filled. Also with the embodiment of FIG. 5, there is available on the inside of the sheet 10 sufficient space for description and for additional pictures, ornaments, etc. Various other contents for the block 27 with the cutout 28 are also conceivable, such as candies, colored pencils, etc. It would also be possible to make the container or block 27 in the form of a child's toy, for example as a block-like pictorial mosaic.

Sealing the foldable letter that has been made ready for mailing, i.e. securing the closure flaps 17, 18, 19 to the surface of the paper located below them, is expediently effected with means that prevent destruction of the letter. For this purpose, a number of self-sticking materials are commercially available, such as those used, for example, for conventional envelopes that are subject to duty. It would also be possible to use thin sticky closures.

FIGS. 6–10 show a closure technique which, while fully preserving the secrecy of the mail, makes it possible in a particularly easy manner to prevent damage to the square sheet 10 when the letter is later opened. Involved here are strips that are provided on one side with adhesive, such as glue that is to be moistened, in other words, so-called gumming. The strips are in the form of detachable strips 31, 32, 33. These strips are disposed on the outsides of the free edges 12 of those closure flaps 18, 19 which are attached to the long sides 15 of the rectangle 14 that is inscribed in the square 10. The smaller closure flap 19 has two strips 33, while the larger closure flap 18 has two strips, each of which comprises two parts 31, 32. All of the strips are connected to those inclined sides of the triangular closure flaps 18, 19 that at the same time form a part of the edges 12 of the square 10. The detachability of the strips 31, 32, 33 from their associated closure flaps 18, 19 is brought about by linear perforations 34 that extend along the edges 12 of the square 10. The perforations 34 are expediently formed as a function of the quality, and especially of the weight, of the paper that is used for the foldable letter in such a way that in every instance the strips can be separated relatively cleanly and reliably from the closure flaps. This can, for example, be effected by the expedient selection of the size of the holes and their distance from one another.

Coating the strips with adhesive on those surfaces intended therefor is effected in the surface regions 35 that are disposed next to the perforations 34 but do not contact them, and that otherwise extend over the entire surface of the strip. This prevents the workability of the perforations from being adversely affected by the adhesive during detachment.

A short perforation line 36 makes it possible to have the strips 31, 32 on the closure flap 18 in two parts. This perforation line 36 extends at right angles to the pertaining perforation line 34 and is located where it crosses the strip 33 disposed thereunder when the letter is closed. In other words, the two-part strips 31, 32 are provided at that location with a congruent, transversely extending perforation 36 (see FIGS. 7–9). These measures contribute significantly to the damage-free opening of the foldable letter, as will be described subsequently.

In place of the short, transversely extending perforation lines 36, the strips 31, 36 could also be provided with an appropriate punched-out portion of linear or triangular shape that extends congruently to the perforation line disposed therebelow. The purpose of this is that it is not necessary to separate a double thickness of paper when the foldable letter is opened. In addition, it is easier to compensate for certain shifts of the paper layers during folding of the letter, as could occur by carelessness or poor vision on the part of the user. For this purpose, the transversely extending notch at the location of the perforation 36 expediently has a width that is several times that of the perforation of the strip disposed therebelow, for example a width of 2–3 mm.

Figure 8:
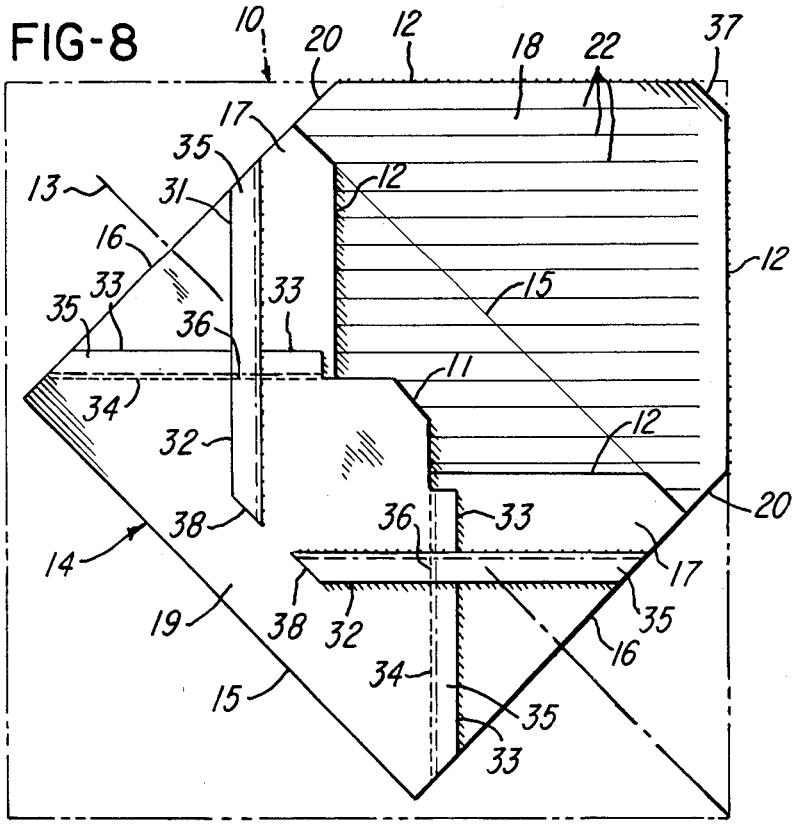

Neither of the strips 33 of the closure flap 19 extends over the entire length of the pertaining inclined edge 12 of the closure flap, but rather ends at such a distance from the free corner 11 yet corresponding to the region in which the closure flap 19 overlaps the two smaller closure flaps 17 that are disposed to the side of the closure flap 19 and are connected to the short sides 16 of the rectangle (see FIG. 8). This measure is necessary in order to not inadvertently glue or otherwise stick the closure flap 19 to the message side of the foldable letter.

The free corner 11 of the larger closure flap 18 has a cut-off point, with the cut-off edge 37 being so great, or having such a length, that it permits easy insertion of a device customarily used to open letters for separating the perforations. The cut-off of the point of the closure flap 18 should preferably have the same length as the cut-outs or notches 20 on both sides of this closure flap, so that the same opening device can be inserted where desired. Furthermore, the edges 38 of the detachable strips 31, 32, 33, where the latter border the side edges of the notches 20, 21 of the square 10, and the cut-off points 11 of the closure flaps 18, 19, extend in a straight line from the pertaining edges of the notches or cut-offs (see FIG. 6).

Figure 6:
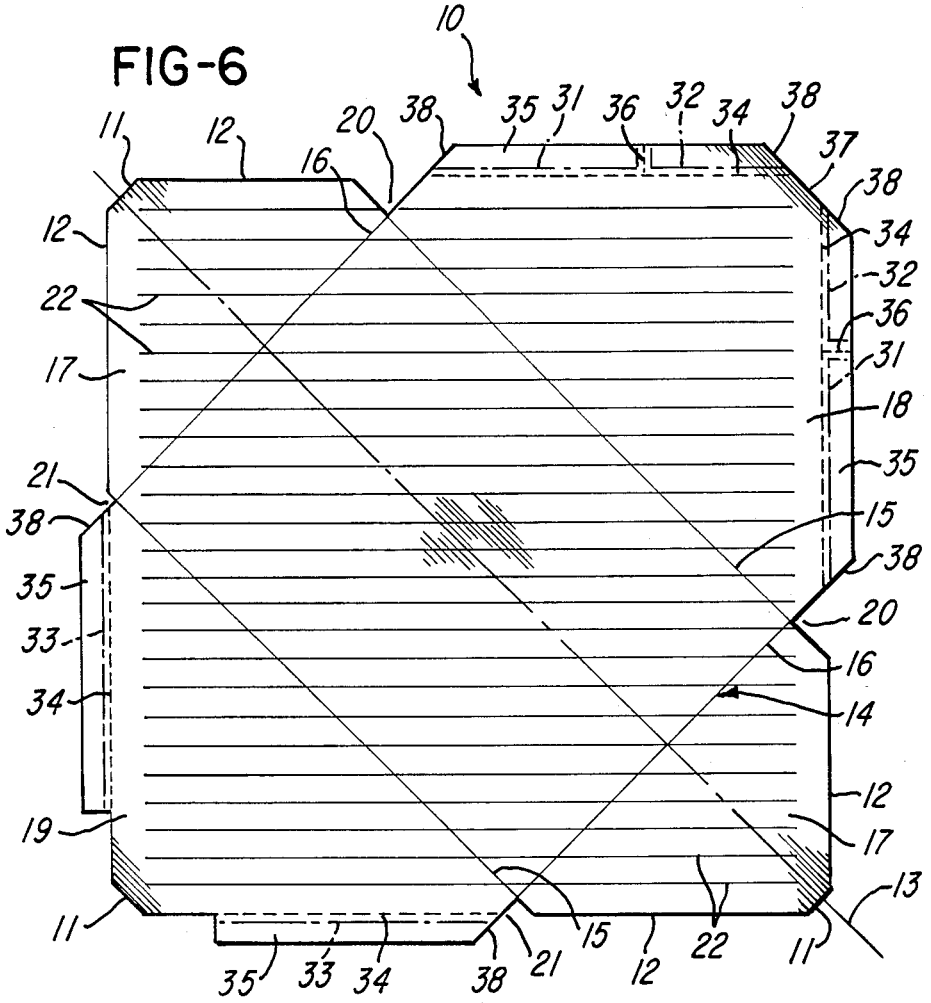
Figure 7:
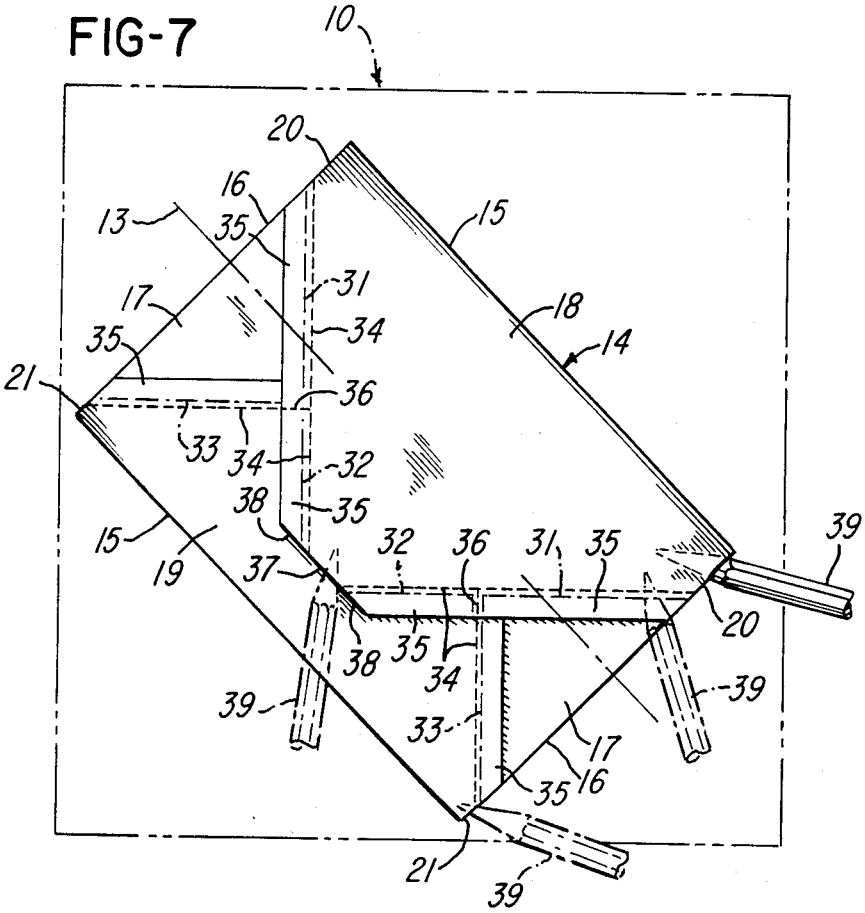
Figure 9:
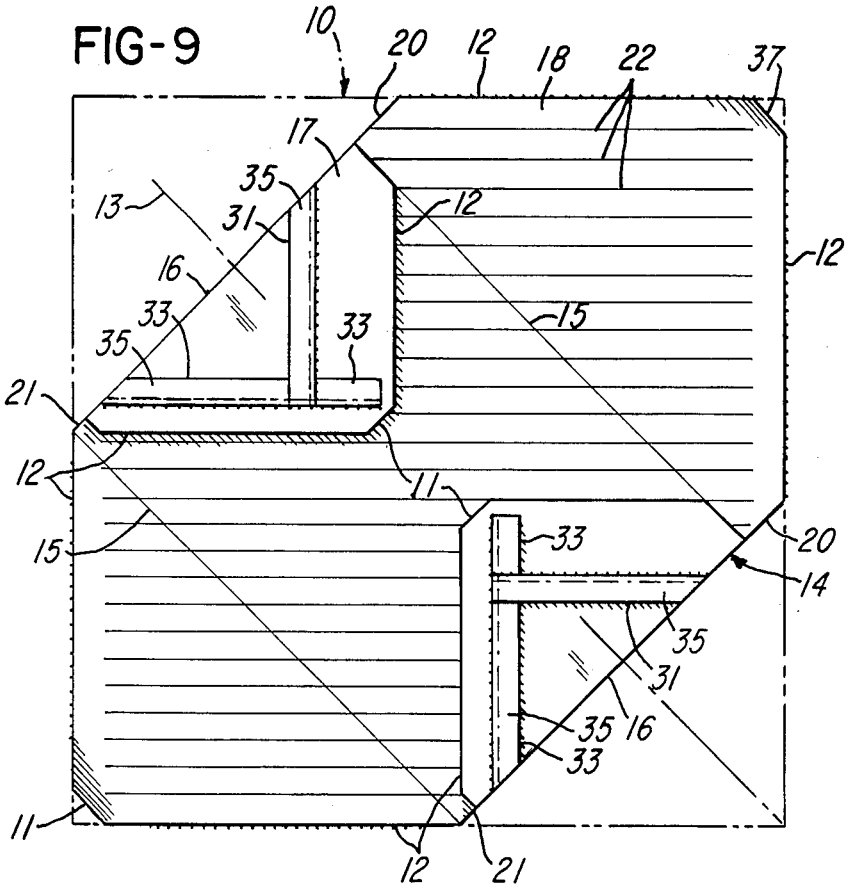
Figure 10:
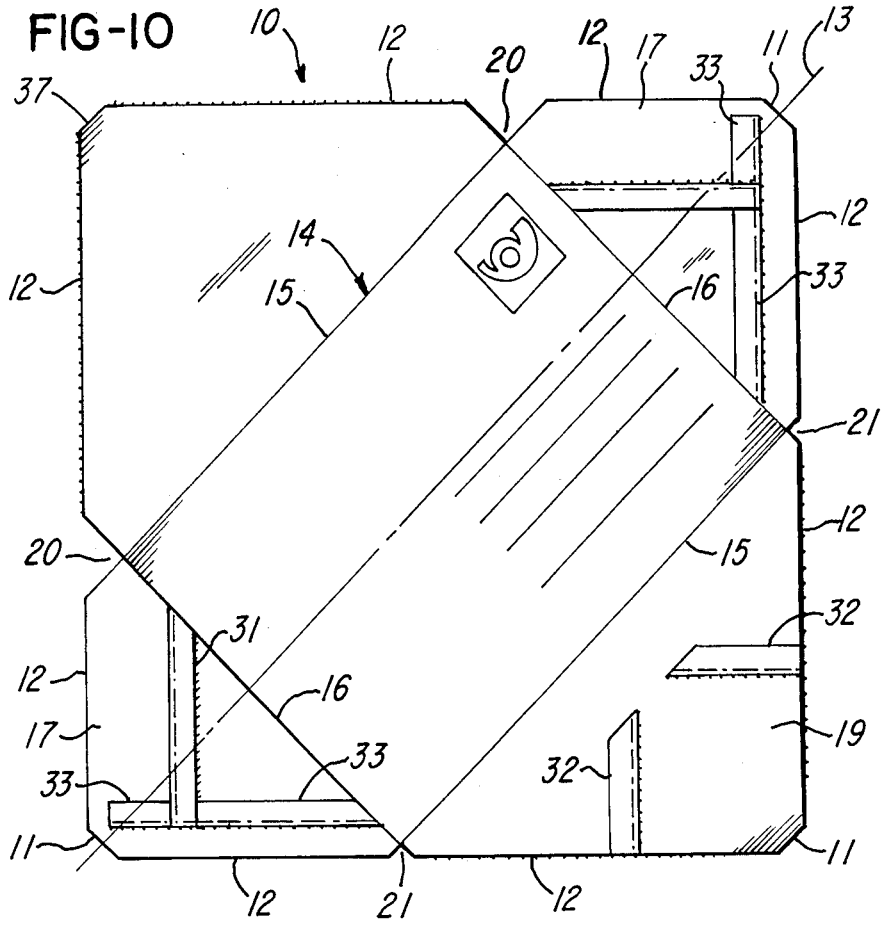

After the message has been written on the foldable letter, the procedure for closing the latter can be seen by viewing FIG. 6, and the procedure for again opening the letter can be seen from FIGS. 7–9. As shown in FIG. 6, to close and seal the letter, the two smaller closure flaps 17 are first folded inwardly about the short sides 16 of the rectangle 14, whereupon the closure flap 19 is creased along the associated long side 15 of the rectangle 14, and is then folded over and placed upon the closure flap 17. The previously moistened gumming or the like of the strips 33 are at the same time pressed against the closure flap 17, so that these three closure flaps are secured to one another. Subsequently, the adhesive of the strips 31, 32 of the larger closure flap 18 is made adhesive, and this closure flap is folded about its fold line along the rectangle 14 and onto the remaining three closure flaps, to which it is secured by being pressed as is the case with a conventional envelope. The foldable letter is now completely closed and sealed, and has the appearance shown in FIG. 7. This closure assures the secrecy of the letter during the postal process.

To open the letter, a letter opener or pencil 39 is inserted, as shown in FIG. 7, in one of the two notches 20 or in the cut-off edge 37 of the closure flap corner 11; by pushing such a device sideways, the perforation 34 is slit open. After one of the inclined edges of the outer, larger closure flap 18 is separated in this manner from the two-part strip 31, 32, the same process is repeated with the pencil 39 on the other inclined edge. The closure flap 18 can now be folded up and bent back, resulting in the position of the foldable letter shown in FIG. 8. The important thing is that the two strips 31, 32 remain stuck to the closure flaps 17 and 19. To further unfold or open the letter, the pencil 39 is now placed at one end of the perforation 34 of one of the two strips 33, whereupon this perforation is slit open by sliding the pencil sideways. This is done successively on both of the inclined edges of the closure flap 19. In so doing, the pencil also traverses each of the two-part strips 31, 32 disposed on the pertaining side, and in particular does so precisely at that location where the transverse perforation 36 is located, the significance and purpose of which was already clearly described. When both of the perforations 34 along the inclined edges of the closure flap 19 have been separated, this closure flap can be lifted up and folded outwardly, so that the position of the foldable letter illustrated in FIG. 9 results. The important thing is that the strips 33 remain stuck to the closure flaps 17.

To facilitate placement of the device 39 for separating the perforations 34, it may be advisable to let the respective perforations extend to the outer contour of the closed letter in a notch of, 5 mm length, for example. The notch thus merges with the line of the perforation, i.e. the notch acts like a section of already separated perforation. In the illustration of FIG. 7, four such notches would be provided, namely one at each of the outer ends of the perforation lines 34.

If now the two small closure flaps 17 are folded outwardly, the foldable letter is again completely opened and offers to the reader a complete sheet having a square basic shape, and in particular one not having the strips 31, 32, 33 that are visible in FIG. 6. The back of the foldable letter, on which is written the respective message, has the appearance, after the letter is opened, illustrated in FIG. 10. From here one can see that the strips 31, 32, 33 that in FIG. 6 still project outwardly from the edges of the square 10, are now, after separation of the closure flaps 18, 19, stuck to the back side of the three closure flaps 17, 19, where they are not visible to the reader of the letter, and cannot impair the text of the letter or possible drawings or other pictorial illustrations. This advantage is also advantageous when the foldable letter is in the form of a composite, with carbon copies being disposed on the inner side of the foldable letter. For example, three pages of carbon copies of the same size as the foldable letter may be involved, with these pages being secured in an easily separated manner on the upper edge 12 of the letter by means of conventional glued edges, so that the composite can also be placed in a typewriter. This embodiment is not illustrated in the drawings.

The features of the subject matter of this application disclosed in the previous specification, the claims, the abstract, and the drawings can be important either individually or in any desired combination for practicing the various embodiments of the invention.

The present invention is, of course, in no way restricted to the specific disclosure of the specification and drawings, but also encompasses any modifications within the scope of the appended claims.

I claim:

1. A foldable letter that can be mailed, and including a sheet of paper having an essentially square basic shape within which, on both sides of said sheet of paper, there appears a rectangular field that is of such a size, and that is disposed non-symmetrically and at an angle relative to the square in such a way, that the corners of the rectangle inscribed in the square are spaced from the edges of the square; at those locations where the corners of the rectangle are near the edges of the square, triangular notches are provided in said square, with the most indented point of each of said notches coinciding with a corner of said rectangle; the four sides of said rectangle, namely two long sides and two short sides, each form both a folding line and a base of a triangular closure flap; after the closure flaps have been folded over to one side, the foldable letter can be sealed as a rectangular letter, with strips having an adhesive on one side being provided to secure said closure flaps; the improvement wherein:

the long sides of said rectangular field are parallel to an imaginary corner-to-corner diagonal of said square, but are disposed non-symmetrically relative to said diagonal in such a way that the four triangular closure flaps, after having been folded over to one and the same side, completely seal the foldable letter via overlapping ones of their edge portions, which are to be glued, whereby near these edge portions of some of said closure flaps, and on one side of the latter, strip-like sections are provided that have said adhesive provided thereon;

said notches of said square being of two different depths, with one pair of each being provided; one pair of notches of a first depth being disposed at opposite ends of one of said long sides of said rectangular field, and the other pair of notches of a second depth being disposed at opposite ends of the other of said long sides of said rectangular field, so that the two wider triangular closure flaps non-symmetrically overlap said rectangular field after being folded over.

2. A foldable letter according to claim 1, in which said strip-like sections that are near said edge portions of some of said closure flaps, and that are provided on one side with said adhesive, are in the form of detachable strips disposed on the outer sides of said edge portions of those closure flaps having as their base said long sides of said rectangle; said detachable strips are connected to said edge portions of said closure flaps in such a way that when a sealed letter is opened, said detachable strips remain stuck to the non-message side of said square, so that the opened letter assumes a square basic shape without detachable strips.

3. A foldable letter according to claim 2, in which said detachable strips, to facilitate detachment thereof, are provided with perforation means along said common edge where said strips are connected to said closure flaps.

4. A foldable letter according to claim 3, in which those detachable strips that are disposed over other detachable strips when said letter is sealed, are each provided with a congruent, transversely extending second perforation at that location where said former detachable strips cross over the perforation means of the detachable strips disposed therebelow.

5. A foldable letter according to claim 3, in which those detachable strips that are disposed over other detachable strips when said letter is sealed, are each provided with an appropriately positioned and sized slot-like means at that location where said former detachable strips cross over the perforation means of the detachable strips disposed therebelow.

6. A foldable letter according to claim 5, in which said slot-like means has a width equal to several times that of the perforation means of the detachable strip disposed below it.

7. A foldable letter according to claim 6, in which that wider triangular closure flap disposed along one of said long sides of said rectangular field between the shorter-depth pair of notches of said square is provided with two of said detachable strips, one along each side; this closure flap has a corner remote from its base, with each of said detachable strips of this closure flap being spaced from said corner thereof to form a strip-free region that overlaps the two narrower closure flaps disposed on each side of this wider closure flap and connected to said short sides of said rectangular field, when said last-mentioned wider closure flap is folded over the already folded-in narrower closure flaps.

8. A foldable letter according to claim 7, in which the other wider closure flap disposed along the other long side of said rectangular field has a cut-off corner remote from its base; the length of this cut-off is sufficient to permit easy introduction therein of a device for ripping open the adjacent perforation.

9. A foldable letter according to claim 8, in which each of said detachable strips is provided with end edges, whereby those of said end edges that border said notches of said square and said cut-off of said one wider closure flap extend as a linear continuation of the adjacent ones of said notches and cut-off.

10. A foldable letter according to claim 7, in which said detachable strips each have a surface that is provided with said adhesive, with said surfaces being spaced from said perforation means.

11. A foldable letter according to claim 3, in which a given perforation means forming the outer contour of a closed letter ends in a notch of sufficient size to facilitate introduction of a device for ripping open said perforation means.

12. A foldable letter according to claim 1, in which the corners of said square are non-angular.

13. A foldable letter according to claim 1, in which said rectangular field is surrounded by parallel double folding lines, so that by creasing and folding along said folding lines a box for goods to be sent is formed.

14. A foldable letter according to claim 13, which includes intermediate folding parts integrally formed in said notches as hinges, with each of said folding parts comprising two articulatedly interconnected triangles, the common bases of which correspond to the height of the planned box; when said triangular closure flaps are folded over, said folding parts pivot into the interior of the box.

15. A foldable letter according to claim 13, which includes a separate container that tightly fills the box formed by said letter.

16. A foldable letter according to claim 15, in which said container is provided with separate cover means.

17. A foldable letter according to claim 15, in which said container comprises a block having a central accommodating recess that is covered by transparent material.

18. A foldable letter according to claim 15, in which said container, for accommodating at least one fresh plant, is provided with a sealable liquid nutrient container for the stem of said plant.

19. A foldable letter according to claim 15, in which said container is in the form of a toy.

20. A foldable letter according to claim 1, in which said square has a message side that is provided with a pictorial representation.

21. A foldable letter according to claim 1, in which said square basic shape has a dimension of 210×210 mm.

22. A foldable letter according to claim 1, in which said rectangular field has a size of 114×162 mm.

23. A foldable letter according to claim 1, which is in the form of a set of carbons, with at least one sheet of self-copying paper being detachably connected to one of said edges of said square.

24. A foldable letter according to claim 1, in which said sheet of paper is at least partially reinforced.

* * * * *